US009351557B2

(12) United States Patent
Inouye

(10) Patent No.: US 9,351,557 B2
(45) Date of Patent: May 31, 2016

(54) SURVIVAL GEAR BACKPACK

(76) Inventor: Todd F. Inouye, Oro Valley, AZ (US)

( * ) Notice: Subject to any disclaimer, the term of this patent is extended or adjusted under 35 U.S.C. 154(b) by 689 days.

(21) Appl. No.: 13/191,337

(22) Filed: Jul. 26, 2011

(65) Prior Publication Data

US 2012/0018477 A1 Jan. 26, 2012

Related U.S. Application Data

(60) Provisional application No. 61/367,764, filed on Jul. 26, 2010.

(51) Int. Cl.

| | |
|---|---|
| ***A45F 3/04*** | (2006.01) |
| ***A45F 3/06*** | (2006.01) |
| ***F41H 1/02*** | (2006.01) |
| ***A45F 4/02*** | (2006.01) |

(52) U.S. Cl.

CPC ... *A45F 3/06* (2013.01); *A45F 4/02* (2013.01); *F41H 1/02* (2013.01); *A45F 3/04* (2013.01)

(58) Field of Classification Search

CPC ..... A45F 3/06; A45F 4/02; A45F 3/04; F41H 1/02

USPC ..... 224/627, 576, 153, 630, 637–640; 2/2.5, 462

See application file for complete search history.

(56) References Cited

U.S. PATENT DOCUMENTS

| | | | | |
|---|---|---|---|---|
| 5,361,412 | A | 11/1994 | Perry | |
| 5,909,802 | A * | 6/1999 | Puco et al. | 2/102 |
| 6,122,778 | A * | 9/2000 | Cohen | 5/81.1 R |
| 6,185,738 | B1 * | 2/2001 | Sidebottom | 2/2.5 |
| 6,419,132 | B1 | 7/2002 | Reed et al. | |
| 2007/0083975 | A1 * | 4/2007 | Senegal | 2/102 |
| 2007/0170219 | A1 | 7/2007 | Ballarta et al. | |
| 2007/0226871 | A1 * | 10/2007 | Hood | 2/69 |
| 2007/0272719 | A1 * | 11/2007 | Laughton | 224/629 |
| 2008/0023513 | A1 * | 1/2008 | Hadj-Chikh | 224/645 |
| 2009/0014490 | A1 | 1/2009 | Bradley | |
| 2009/0127299 | A1 * | 5/2009 | Jamlang | 224/153 |
| 2009/0282595 | A1 * | 11/2009 | Branson et al. | 2/2.5 |
| 2010/0025446 | A1 | 2/2010 | Eberle | |

FOREIGN PATENT DOCUMENTS

WO WO 2007063518 A2 * 6/2007

* cited by examiner

*Primary Examiner* — Justin Larson
(74) *Attorney, Agent, or Firm* — Richard C. Litman

(57) ABSTRACT

The survival gear backpack is a backpack having a plurality of internal pockets adapted to contain items that would be needed in crisis situations while maintaining its function as a viable storage vessel for personal items usable in non-crisis situations. The backpack also includes pockets that house ballistic-protective inserts. The pockets and inserts are positioned to protect the front, rear and sides of the upper torso.

8 Claims, 5 Drawing Sheets

SURVIVAL GEAR BACKPACK

CROSS-REFERENCE TO RELATED APPLICATION

This application claims the benefit of U.S. Provisional Patent Application Ser. No. 61/367,764, filed Jul. 26, 2010.

BACKGROUND OF THE INVENTION

1. Field of the Invention

The present invention generally relates to survival and protective gear, and more particularly to a survival gear backpack incorporating ballistic-protective inserts.

2. Description of the Related Art

Recent disasters perpetuated by man (terrorism, nuclear accidents, oil spills, etc.) along with natural disasters (floods, earthquakes, forest fires, etc.) have demonstrated the need for emergency preparedness. Government agencies have been established in many countries to address the need for emergency preparations in the event of one or more of the above-mentioned disasters. One of the many suggested ideas for preparations includes the acquisition of means to personally transport emergency and protective items. During a crisis such needed items as small tools, small firearms, food packets, medical supplies and other emergency, survival equipment must often be carried on ones person. In certain situations it may also be necessary to utilize some form of personal ballistic protection. Thus, a survival gear backpack solving the aforementioned problems is desired.

SUMMARY OF THE INVENTION

The survival gear backpack is a structure that includes a plurality of storage sections adapted to contain items that would be needed in crisis and non-crisis situations. Varying arrays of fixed and/or removable pockets are disposed in one or more of the storage sections. The backpack also includes pockets that are specifically designed to house ballistic protection inserts. The ballistic-protective inserts are positioned to protect the front, rear and sides of the upper torso. A strap/harness arrangement built within the backpack structure has structural load strengths equal to or exceeding that of rappel harnesses.

Accordingly, the invention presents a backpack designed to efficiently contain food, water, emergency medical supplies, defensive weapons, tools, etc. that might be needed in survival-type situations. The backpack also provides adequate personal storage volume for use during non-emergency situations. The backpack is designed to provide removable inserts that afford ballistic protection for the full upper torso. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
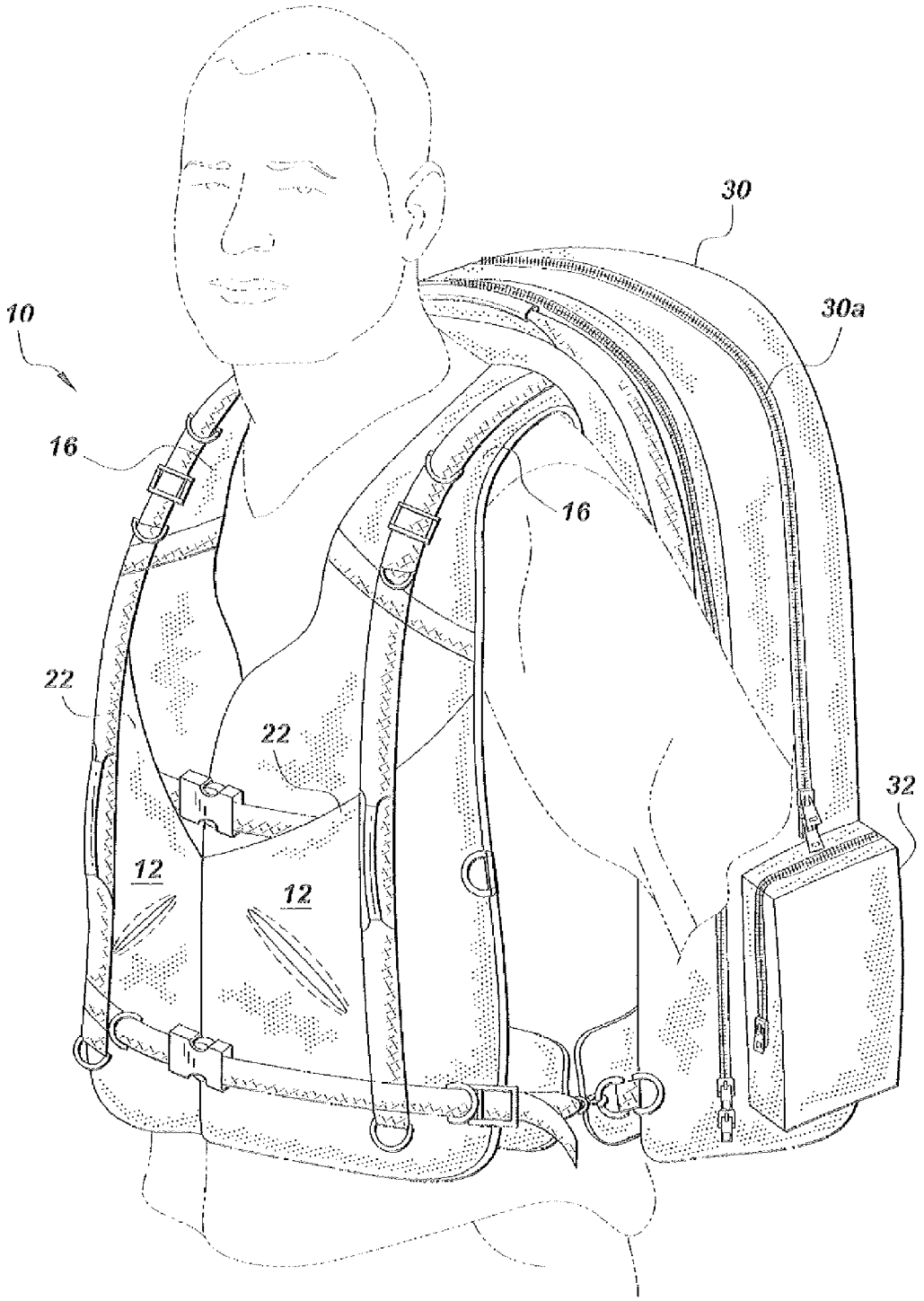
FIG. 1 is an environmental, perspective view of a survival gear backpack according to the present invention.
Figure 2:
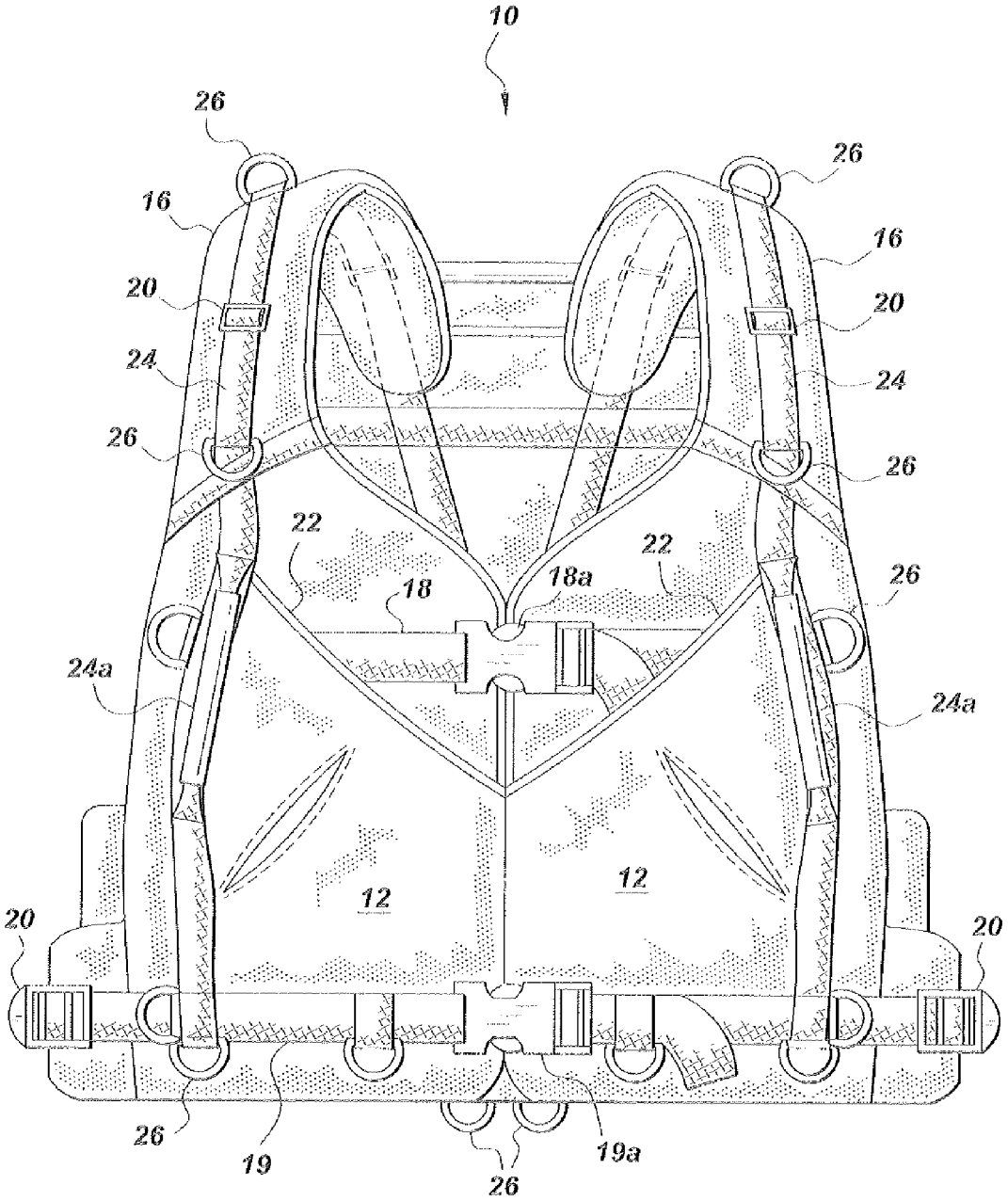
FIG. 2 is a front view of a survival gear backpack according to the present invention.

Attention is first directed to FIGS. 1 and 2 of the drawings, wherein the survival gear backpack is generally indicated at 10. Backpack 10 can be fabricated from any suitable, substantially rugged material (canvas, nylon, etc.) and may be made water-resistant, if desired. The backpack 10 comprises vest-like front panels 12 adapted for positioning at the front torso area of the wearer. A pair of padded, oversized shoulder straps 16 is integral with and extend from front panels 12. Front securing straps 18, 19 having respective quick release fasteners 18*a*, 19*a* are provided to secure panels 12 in a closed position covering the stomach and chest areas of the torso. Securing straps 18, 19 and shoulder straps 16 are provided with adjustment buckles or the like 20 (FIG. 2) to permit adjustment of the panels 12 on the torso of the wearer or to secure excess webbing. Securing strap 19 is also provided with an adjustment buckle or the like 20 at each side thereof to further secure excess webbing.

One or more pockets 22 are provided on the front panels to house small emergency items and may include a universal plug-in port therein. As illustrated, each pocket 22 is provided with a slanted entrance to enhance access thereto. It should be recognized, however, that the entrance could assume vertical or horizontal orientation, if desired. The pockets may be provided with a conventional closure (zipper, button, hook-and-loop, etc.), if desired.

Identical respective harness straps 24 are secured to the outer surface of each front panel 12. Each strap 24 is provided with a low profile handle portion 24*a* to provide means for grasping the backpack. A main storage compartment 30 is securely attached to the front panel, shoulder straps, and harness strap assembly. As more clearly explained below, main compartment 30 includes therein at least one internal secondary compartment and may include a variety of auxiliary pocket arrangements. A conventional zipper 30*a* or the like provides access to main compartment 30. Ancillary compartments 32 are attached to the outer surface of compartment 30. Compartments 32 can be removably attached to the outer surface in any convenient manner, e.g., hook and loop fasteners. Compartments 32 may house emergency items, including a small firearm.

Figure 3:
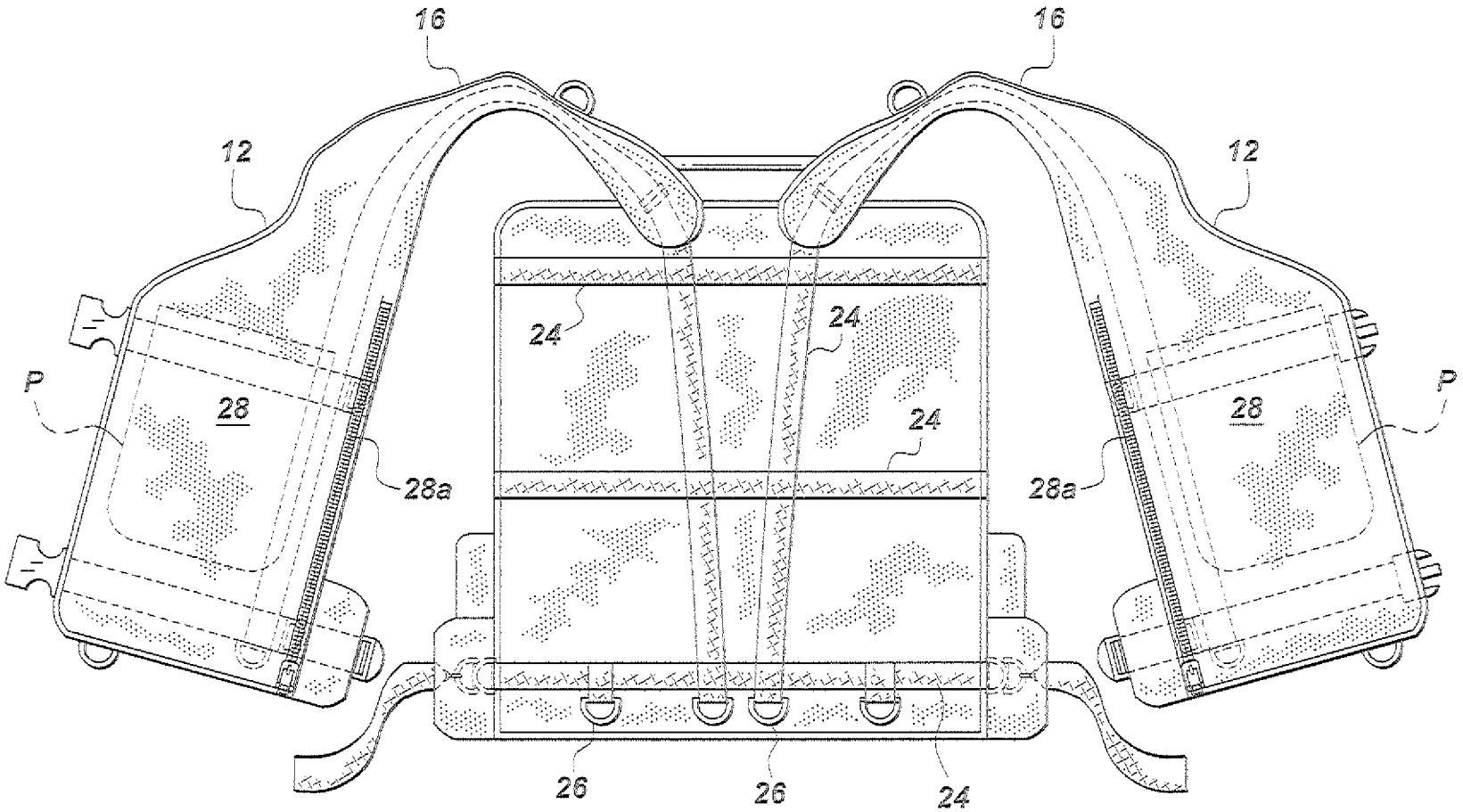
FIG. 3 is a front view of a survival gear backpack according to the present invention, shown with the front panels unfastened.
Figure 4:
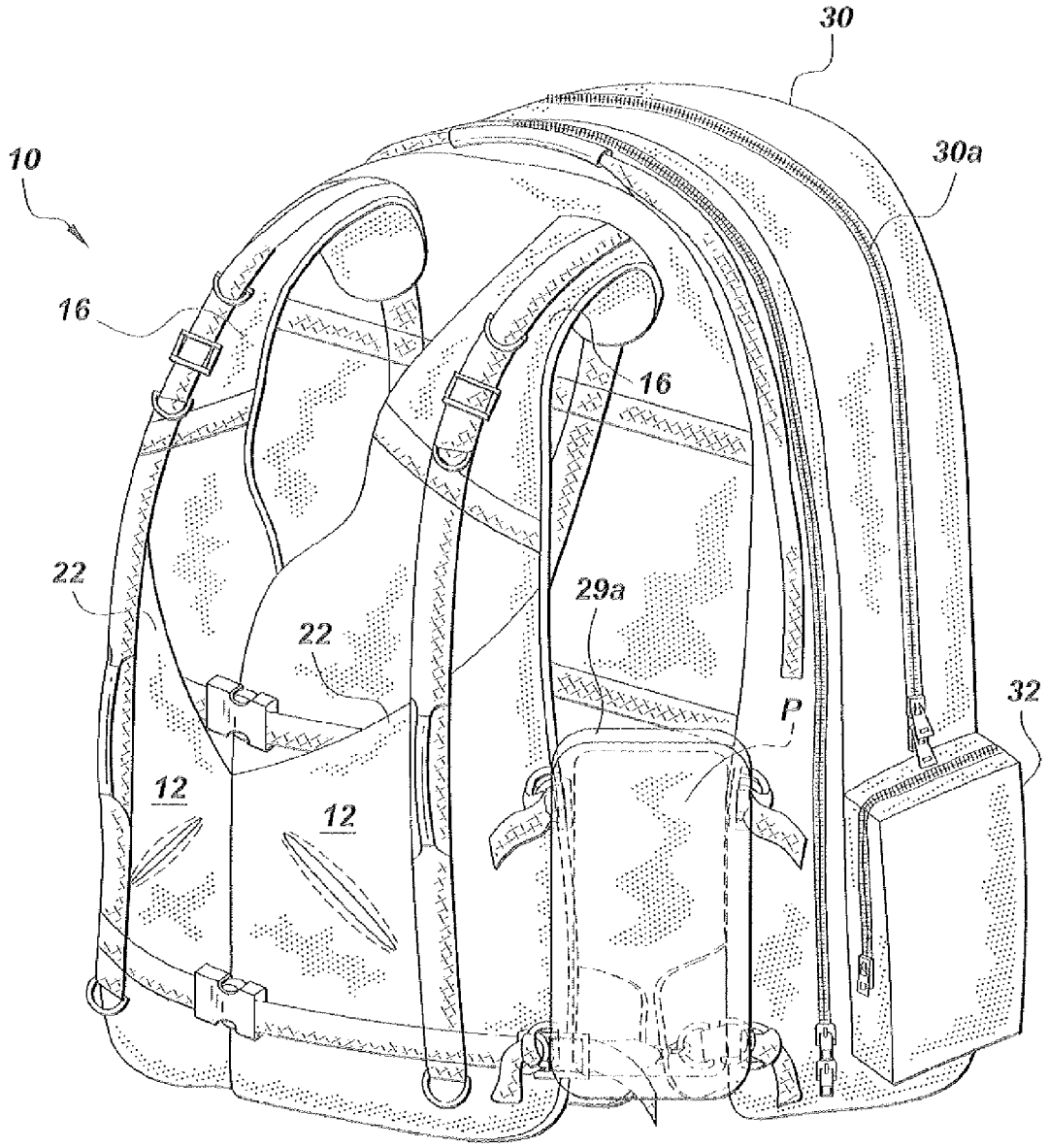
FIG. 4 is a perspective view of a survival gear backpack according to the present invention, showing a removable, side pocket affording ballistic protection.

As best seen in FIG. 3, harness-strap webbing structure 24 is built within the backpack and allows the backpack to have the load strengths of rappel harnesses, as mentioned above. An array of attached hardware 26 (D-rings, ladder locks, buckles, etc.) is attached to the harness-strap webbing structure and other parts of the backpack. The hardware 26 is positioned in configurations as desired, and may be employed to attach other emergency items to the backpack. Respective pockets 28 having entrances at 28*a* are formed on the inner surface of each panel 12. Each pocket is adapted to house an insert P (shown in phantom lines) therein. The insert P is constructed from a material, such as Kevlar® (Kevlar is the brand name for a para-aramid synthetic fiber developed at DuPont and utilized as body armor) that offers a degree of ballistic protection for the stomach and chest areas of the torso. The inserts P may be removable from the pockets 28 or permanently secured therein. FIG. 4 discloses the backpack wherein identically configured removable side protective pockets 29 (only one is shown, the other being symmetrical) are utilized to protect the side areas of the torso. Each side pocket 29 is provided with an opening 29*a* for receiving and retaining a protective ballistic insert P therein. Each pocket 29 is attached to the backpack via D-rings or by hook-and-loop fasteners or the like.

Figure 5:
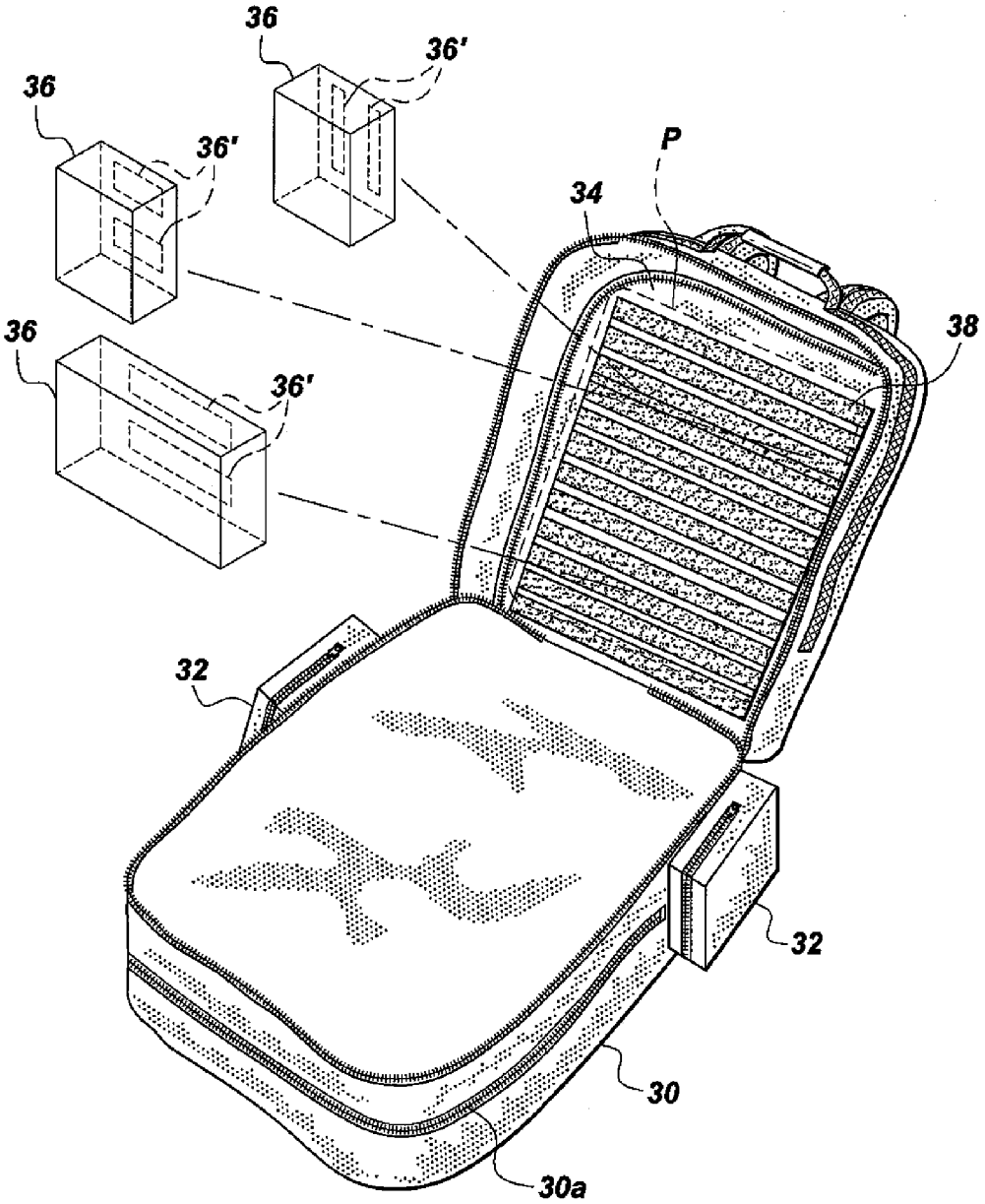
FIG. 5 is a perspective view of a survival gear backpack according to the present invention, shown with the internal compartment in an open position.

As best seen in FIG. 5, an internal secondary compartment 34 is disposed adjacent main compartment 30 and is isolated therefrom. The secondary compartment 34 is provided with an opening adapted for closure by a conventional closure fastener, such as a zipper or the like. Whereas the main compartment 30 is adapted to house items of ordinary nature, the secondary compartment 34 is adapted to house items 36 that may be specific to emergency/medical/survival scenarios (bandages, water, medicine, etc.). Each of the items 36 includes hook-and-loop fasteners 36'. Compartment 34 is configured with an array of fixed and removable pockets and includes hook-and-loop fasteners 38 for securing the items 36, 36' therein, including affixable modular containers or any form of structured storage dedicated for, but not limited to, emergency equipment storage. A ballistic insert P is disposed in the secondary compartment behind the hook-and-loop fasteners for protecting the back area of the torso. Alternatively, the ballistic insert may be disposed in the main compartment, if desired.

It is to be understood that the present invention is not limited to the embodiment described above, but encompasses any and all embodiments within the scope of the following claims.

I claim:

1. A survival gear backpack, comprising:

a main compartment having a first wall and a second wall defining the main compartment, wherein the main compartment is selectively openable about its periphery;

a secondary compartment disposed adjacent to and attached to the second wall of the main compartment, the secondary compartment being substantially coextensive with the main compartment and isolated therefrom, the secondary compartment having an outer wall and an inner wall wherein the inner wall includes fastening elements, wherein the secondary compartment is selectively openable about its periphery whereby the secondary compartment substantially detaches from the main compartment to provide access to the inner wall fastening elements;

a plurality of containers, each of the containers including fastening elements for engaging corresponding fastening elements of the inner wall thereby securing the containers within the secondary compartment;

a pair of shoulder straps attached to the outer wall of the secondary compartment;

a respective panel member integral with each of the respective shoulder straps and extending therefrom, each of the panel members having a front face;

respective first pockets disposed in the front face of each of the panel members;

a respective harness strap secured on the front faces of the shoulder straps;

a plurality of harness straps secured to each front face of each of the panel members;

a plurality of harness straps secured to the outer wall of the secondary compartment; and a ballistic protective insert disposed in the secondary compartment and located between the fastening elements and the outer wall for protecting a back torso area of the backpack wearer.

2. The survival gear backpack according to claim 1, wherein each said first pocket has a slanted entrance.

3. The survival gear backpack according to claim 1, wherein said main compartment further includes an outer wall having at least one ancillary compartment removably attached to the outer wall, the ancillary compartment being adapted to house a small firearm therein.

4. The survival gear backpack according to claim 1, wherein each said panel member has an inner face, the backpack further comprising respective second pockets disposed on the inner face of each said panel member.

5. The survival gear backpack according to claim 4, further comprising first and second respective ballistic protective inserts respectively disposed in each of the respective second pockets.

6. The survival gear backpack according to claim 1, further including securing straps disposed on each said panel member for securing said panel members in a closed position.

7. The survival gear backpack according to claim 6, further including a plurality of D-rings secured to said harness strap and said securing straps.

8. The survival gear backpack according to claim 1, further including first and second respective ballistic protective inserts respectively disposed in each of the panel members for protecting a front torso area of a wearer.

* * * * *